United States Patent [19]

Kullman, Jr.

[11] 4,068,796

[45] Jan. 17, 1978

[54] CONTAINER WITH INTEGRAL CORNER POSTS

[75] Inventor: Thomas D. Kullman, Jr., Wheeling, W. Va.

[73] Assignee: Consolidated Packaging Corporation, Chicago, Ill.

[21] Appl. No.: 652,732

[22] Filed: Jan. 27, 1976

[51] Int. Cl.[2] ..... B65D 5/42

[52] U.S. Cl. ..... 229/49; 229/23 R; 229/14 C

[58] Field of Search ..... 229/23 C, 23 R, 37 E, 229/49, 14 C

[56] References Cited

U.S. PATENT DOCUMENTS

| | | | |
|---|---|---|---|
| 2,521,989 | 9/1950 | McPherson | 229/23 R |
| 2,709,032 | 5/1955 | Ritchie | 229/49 X |
| 2,775,393 | 12/1956 | Rugg | 229/49 X |
| 3,072,314 | 1/1963 | Keene | 229/49 X |
| 3,184,136 | 5/1965 | Forbes, Jr. | 229/49 X |
| 3,709,425 | 1/1973 | Stapp | 229/236 |
| 3,831,836 | 8/1974 | Ellison et al. | 229/49 |
| 3,850,362 | 11/1974 | Stollberg et al. | 229/49 |
| 3,918,630 | 11/1975 | Meyers | 229/49 X |

FOREIGN PATENT DOCUMENTS

| | | | |
|---|---|---|---|
| 507,925 | 6/1959 | United Kingdom | 229/14 C |

*Primary Examiner*—Davis T. Moorhead

*Attorney, Agent, or Firm*—Hill, Gross, Simpson, Van Santen, Steadman, Chiara & Simpson

[57] ABSTRACT

A reinforced container formed of foldable paper board and having triangular column supports at opposite diagonal corners. The container is double jointed, being formed of two container segments. Each container segment has one inner flap which extends into the container from the point that the container segment is joined with the mating segment. The flap forms a triangular supporting column with the adjacent corner of the container to provide for additional stacking strength.

3 Claims, 3 Drawing Figures

CONTAINER WITH INTEGRAL CORNER POSTS

BACKGROUND OF THE INVENTION

Description of the Prior Art

Containers formed of foldable paper board have utilized various types of reinforcement structures. Prior art patents which illustrate such containers are as follows:

U.S. Pat. No. 2,775,393
U.S. Pat. No. 3,034,698
U.S. Pat. No. 3,047,204
U.S. Pat. No. 3,097,781
U.S. Pat. No. 3,126,144
U.S. Pat. No. 3,159,274
U.S. Pat. No. 3,184,136
U.S. Pat. No. 3,372,813

The above prior art patents make it clear that the broad concept of using reinforced corners or similar structures in cardboard containers is well known in the art. For instance, the Rugg U.S. Pat. No. 2,775,393 shows a collapsible container which has triangular inserts positioned in the corners (FIG. 1) for the purpose of reinforcing the structure. However, the triangular inserts are separately made and then inserted into position in the corners, unlike the present invention.

The Forrer U.S. Pat. No. 3,034,698 shows a container with reinforced corners which are formed integrally with the container. However, these reinforced corners are triangularly shaped and require more complex assembly techniques than the subject invention.

U.S. Pat. No. 3,047,204 shows a carton reinforcing structure which holds the carton in a square condition when it is filled with granular material. U.S. Pat. No. 3,097,781, shows a triangular reinforcing member adjacent the corner of a cardboard container.

Each of the remaining Patents, namely U.S Pat. Nos. 3,126,144, 3,159,274, 3,184,136 and 3,372,813 show different forms of reinforcing structures for cardboard containers to improve the load carrying ability of the container. None of these, however show the arrangement of the present invention.

FIELD OF THE INVENTION

The field of art to which this invention pertains is cardboard containers having reinforced structures in the corners and in particular to a cardboard container which has a reinforcing structure formed by a single lap which extends beyond the body score of the carton to automatically form "corner posts".

SUMMARY OF THE INVENTION

It is an important feature of the present invention to provide an improved cardboard container having greatly increased stacking strength.

It is another feature of the present invention to provide a reinforced container formed of foldable paper board which has reinforced corners to increase the stacking strength of the container.

It is also an object of the present invention to provide a reinforced container formed of foldable paper board which has triangular column supports at opposite diagonal corners of the container wherein the triangular column supports are formed by the corner of the container and a single flap of material extending from one of the side walls of the container.

It is an additional object of the present invention to provide a reinforced container formed of a foldable paper board wherein the container is formed of two container segments, with each container segment having an inner lap extending beyond the body score of the container to fold into the container and overlie an adjacent corner to produce a triangular column support.

These and other objects, features and advantages of the present invention will be understood in greater detail from the description and associated drawings wherein reference numerals are utilized to designate a preferred embodiment.

DESCRIPTION OF THE PREFERRED EMBODIMENT

The present invention relates to a reinforced container formed of a foldable paper board which greatly increases the container stacking strength while minimizing the cost of producing the container. Various reinforced containers have been formed in the past utilizing triangular column supports which when positioned in the corners of the container increase the stacking strength thereof. However, the present invention utilizes a double-jointed cardboard container which has an inner lap formed in such a way that when the container is assembled, the lap is caused to overlie the corners of the container to form a triangular column automatically.

Figure 1:
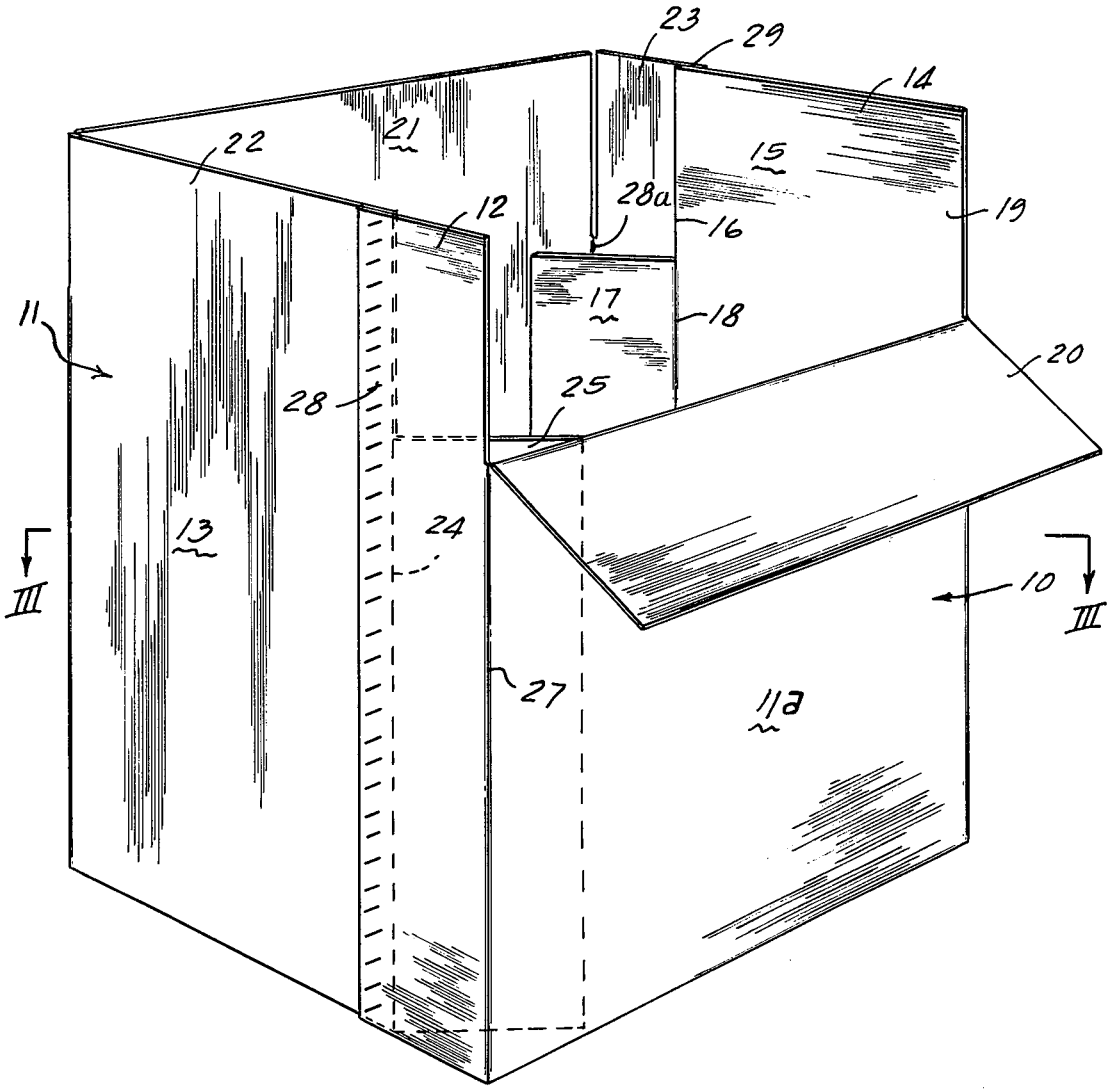
FIG. 1 shows the partially assembled container according to the present invention illustrating the joining points of the first and second container segments and the positioning of the inner flaps which extend inside the container to form the triangular column supports at opposite diagonal corners.

Referring to FIG. 1 in greater detail, the container consists of a first container segment 10 and a second container segment 11. The first container segment 10 is folded to form a side wall **11*a* and a minor portion 12 of a second side wall 13. Also, the container segment 10 has a major portion 14 of a second side wall 15. The vertical edge 16 of the major portion 14 has a flap-like structure or inner lap 17 which extends from the body score 18 of the container. In addition, the container segment 10 has portions 19 and 20** which may be folded to form a top or bottom surface of the container.

In a similar manner, the container segment 11 is folded to form a side wall 21 and a major portion 22 of the side wall 13 as well as a minor portion 23 of the side wall 15. The vertical edge 24 of the major portion 22 has a flap or inner lap 25 which is similar to the inner lap 17.

The inner laps 17 and 25 extend into the container adjacent to the associated corners 26 and 27, respectively. These inner laps overlie the corners in a triangular manner to form a vertical column which provides additional stacking strength for the container.

To assemble the container, the minor portion 12 of the side wall 13 is secured at a seam 28 to the major portion of the side wall 13, the major portion being identified by the numeral 22. Similarly, the major portion 14 of the side wall 15 is joined to the minor portion 23 thereof at a seam 29 as shown. By joining in this way, the inner laps are caused to extend as shown over the respective corners 26 and 27 to form their indicated function.

Figure 2:
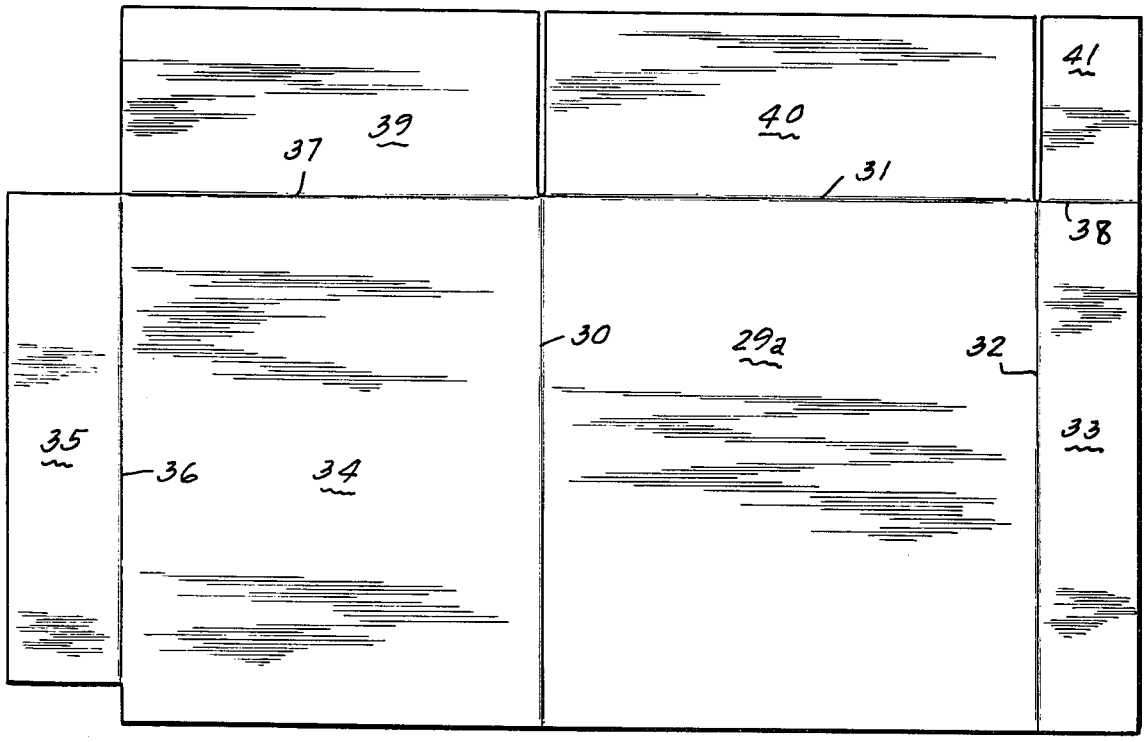
FIG. 2 is a plan view of a container segment blank showing the score lines on which the container is folded to form the assembled structure of FIG. 1.
Figure 3:
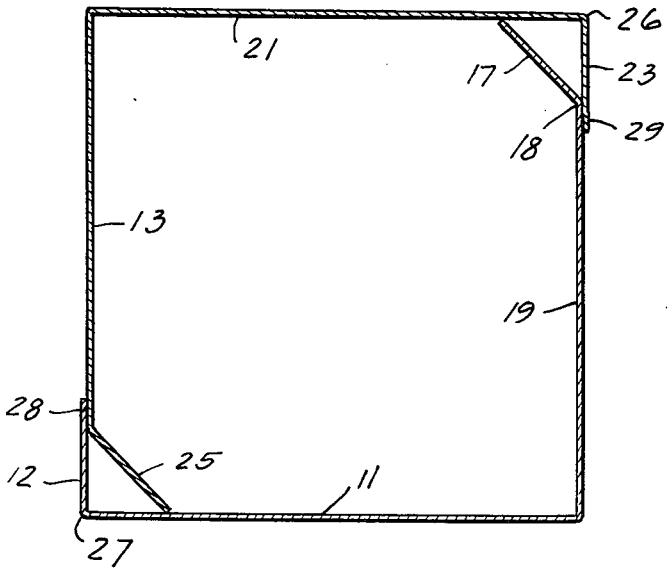
FIG. 3 is a top view of the container of FIG. 1.

Referring to FIG. 2, this figure shows one of the container segments. In particular, this container segment shows a complete side wall 11*a* which is defined by score lines 30, 31 and 27. A minor portion 12 of an additional side wall is shown as being formed integrally at the score 27. Also a major portion 14 of still another side wall is formed integrally at the score 30. An inner lap 17 is formed at a body score 18 and is integral with the major portion of the side wall 14. When the container blank shown in FIG. 2 is mated with its counterpart container blank as shown in FIG. 1, the inner lap is caused to extend over the adjacent corner and provide the container support. The score line 31 as well as the score lines 37 and 38 additionally form the container flaps 40, 19 and 20 which are well known in the art. As can be seen from FIGS. 1 and 2, the triangular column support formed in the container of this invention extends vertically from the bottom of the container to the top edge for the purpose of increasing the ability of the container to support additional containers when stacked with material.

It will be apparent that modifications may be made in the present invention without disparting from the spirit and scope of the claims attached hereto.

I claim:

1. A reinforced container formed of foldable paper board comprising:

a. first and second container segments, b. the first container segment being folded to form a first side wall and a major portion of a second side wall with an intermediate corner, one edge of said first side wall having a minor portion of a third side wall formed therewith with a first associated corner defined thereby, the opposite vertical edge of the major portion of said second side wall having a first inner lap extending therefrom, c. the second container segment being folded to form a fourth side wall and a major portion of said third side wall with an intermediate corner, one edge of said fourth side wall having a minor portion of said second side wall formed therewith with a second associated corner defined thereby, the opposite vertical edge of the major portion of said third side wall having a second inner lap extending therefrom, d. the minor and major portions of said second side wall being joined together at points causing said first inner lap to extend into the container adjacent to said first associated corner, and e. the minor and major portions of said third side wall being joined together at points causing said second inner lap to extend into the container adjacent said second associated corner.

2. A reinforced container in accordance with claim 1 wherein said first and second inner laps are rectangular plane segments extending vertically along the length of the side wall and being caused to overlie said first and second associated corners and form cylindrical supports therewith.

3. A reinforced container in accordance with claim 2 wherein the width of said second and third minor wall portions and the width of said first and second inner laps are calculated to cause said inner laps to overlie said associated corner and form triangular support columns therewith.

* * * * *